US007964830B2

(12) United States Patent
Olden et al.

(10) Patent No.: US 7,964,830 B2
(45) Date of Patent: Jun. 21, 2011

(54) LARGE CROSS-SECTION INTERCEPTOR VEHICLE AND METHOD

(75) Inventors: Thomas A. Olden, Tucson, AZ (US); Robert J. Cavalleri, Coral Springs, FL (US)

(73) Assignee: Raytheon Company, Waltham, MA (US)

( * ) Notice: Subject to any disclaimer, the term of this patent is extended or adjusted under 35 U.S.C. 154(b) by 263 days.

(21) Appl. No.: 12/391,207

(22) Filed: Feb. 23, 2009
(Under 37 CFR 1.47)

(65) Prior Publication Data

US 2010/0213306 A1 Aug. 26, 2010

(51) Int. Cl.
*F42B 15/10* (2006.01)
*B64D 7/00* (2006.01)
*F42B 15/00* (2006.01)

(52) U.S. Cl. ..... 244/3.1; 244/3.15; 244/1 R; 244/110 R; 244/113; 244/110 D; 89/1.11

(58) Field of Classification Search ..... 89/1.11, 89/1.1; 244/3.1, 3.15–3.22, 158.1–158.3, 244/138 R, 138 A, 110 R, 113, 110 D, 1 R, 244/1 TD, 158.9, 159.1–159.3, 110 C; 102/382–388, 102/400–403, 335, 347, 351, 473, 489; 342/5–11, 342/61–65, 175, 195; 114/240 R–240 E, 114/382
See application file for complete search history.

(56) References Cited

U.S. PATENT DOCUMENTS 3,047,259 A * 7/1962 Tatnall et al. ..... 244/138 A
3,064,568 A * 11/1962 Ainslie et al. ..... 102/387
3,212,730 A * 10/1965 Tschudy et al. ..... 244/138 R
3,228,634 A * 1/1966 Chakoian et al. ..... 244/113
3,301,507 A * 1/1967 Mayo et al. ..... 244/159.3
3,351,010 A * 11/1967 Ainslie et al. ..... 102/387
3,568,191 A * 3/1971 Hiester et al. ..... 342/8
3,643,599 A * 2/1972 Hubich ..... 102/388
4,005,655 A * 2/1977 Kleinschmidt et al. ..... 102/386
4,215,836 A * 8/1980 Zacharin ..... 244/138 R
4,231,311 A * 11/1980 Longerich ..... 102/403
4,504,031 A * 3/1985 Andrews ..... 244/113
4,518,137 A * 5/1985 Andrews ..... 244/113
4,565,341 A * 1/1986 Zacharin ..... 244/113
4,696,443 A * 9/1987 Zacharin ..... 244/113
4,768,417 A * 9/1988 Wright ..... 89/1.11
4,832,288 A * 5/1989 Kendall et al. ..... 244/113
4,856,737 A * 8/1989 Zacharin ..... 244/113
4,958,565 A * 9/1990 Koch ..... 102/386
5,069,109 A * 12/1991 Lavan, Jr. ..... 89/1.11
5,108,047 A * 4/1992 Puech ..... 244/113
5,225,627 A * 7/1993 Phillips et al. ..... 102/351

(Continued)

OTHER PUBLICATIONS

"Ballute"; no author listed; no date listed; copyright in the years 2001-2003; posted on the Internet at parachutehistory.com.*

(Continued)

*Primary Examiner* — Bernarr E Gregory
(74) *Attorney, Agent, or Firm* — SoCal IP Law Group LLP; John E. Gunther; Steven C. Sereboff

(57) ABSTRACT

A vehicle may include a vehicle body maneuverable onto a near collision course with a target and a plurality of inflatable ballutes which, when inflated, extend generally radially from the vehicle body. A controller may cause the ballutes to be inflated prior to an anticipated time of collision with the target. A plurality of explosive charges may be attached to at least some of the ballutes. A detonation controller may be coupled to the controller and to the plurality of explosive charges.

17 Claims, 5 Drawing Sheets

U.S. PATENT DOCUMENTS

| | | | | |
|---|---|---|---|---|
| RE34,873 | E * | 3/1995 | Luttrell | 244/1 TD |
| 5,398,614 | A * | 3/1995 | Koenig | 102/387 |
| 5,417,139 | A * | 5/1995 | Boggs et al. | 89/1.11 |
| 5,583,311 | A * | 12/1996 | Rieger | 89/1.11 |
| 5,675,104 | A * | 10/1997 | Schorr et al. | 89/1.11 |
| 5,814,754 | A * | 9/1998 | Mangolds | 89/1.11 |
| 5,826,821 | A * | 10/1998 | Brandon et al. | 244/3.1 |
| 5,988,036 | A * | 11/1999 | Mangolds et al. | 89/1.11 |
| 6,182,553 | B1 * | 2/2001 | Peterson | 89/1.11 |
| 6,264,144 | B1 * | 7/2001 | Thornton | 244/113 |
| 6,325,015 | B1 * | 12/2001 | Garcia et al. | 114/382 |
| 6,502,786 | B2 * | 1/2003 | Rupert et al. | 244/3.1 |
| 6,536,712 | B1 * | 3/2003 | Barenett | 244/158.3 |
| 6,547,189 | B1 * | 4/2003 | Raboin et al. | 244/158.3 |
| 6,612,244 | B1 * | 9/2003 | Grosch et al. | 102/402 |
| 6,626,077 | B1 * | 9/2003 | Gilbert | 89/1.11 |
| 6,666,402 | B2 * | 12/2003 | Rupert et al. | 244/3.1 |
| 6,741,341 | B2 | 5/2004 | DeFlumere | |
| 6,904,838 | B1 * | 6/2005 | Dindl | 89/1.1 |
| 6,957,602 | B1 * | 10/2005 | Koenig et al. | 89/1.11 |
| 7,032,858 | B2 | 4/2006 | Williams | |
| 7,066,093 | B2 * | 6/2006 | Ronn et al. | 102/489 |
| 7,066,427 | B2 * | 6/2006 | Chang | 244/3.19 |
| 7,190,304 | B1 * | 3/2007 | Carlson | 244/3.1 |
| 7,223,224 | B2 | 5/2007 | Card et al. | |
| 7,328,644 | B2 * | 2/2008 | Vickroy | 89/1.11 |
| 7,350,744 | B1 | 4/2008 | Schwartz et al. | |
| 7,377,547 | B2 | 5/2008 | Schimpff et al. | |
| 7,412,916 | B2 * | 8/2008 | Lloyd | 89/1.11 |
| 7,415,917 | B2 | 8/2008 | Lloyd | |
| 7,611,094 | B2 * | 11/2009 | Rom | 244/110 C |
| 7,837,154 | B2 * | 11/2010 | Trabandt et al. | 244/159.1 |
| 2006/0169832 | A1 * | 8/2006 | Glasson | 244/3.1 |

OTHER PUBLICATIONS

A. Hirth et al., Airbag Simulation with LS-DYNA Past-Present-Future, Journal, 2007 Copyright by DYNAmore GmbH, pp. A-I-57 to A-I-74.

The Tass Group, MADYMO Airbag Simulation, State-of-the-Art Techniques for Efficient Airbag Design, article, www.tass.safe.com/madymo, Sep. 2005.

* cited by examiner

LARGE CROSS-SECTION INTERCEPTOR VEHICLE AND METHOD

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to a vehicle and method for intercepting and destroying ballistic missile re-entry vehicles and other targets.

2. Description of the Related Art

Systems for intercepting ballistic missile threats typically reply on a kinetic kill vehicle (KKV), also termed a "hit-to-kill" vehicle, to destroy the threat re-entry vehicle by way of physical collision. A missile carrying the KKV, or a plurality of KKVs, is launched to the place the KKV in a position proximate the trajectory of the target re-entry vehicle. The KKV then detects and tracks the target vehicle and navigates to attempt to physically collide with the target. Exemplary KKV development programs include the Exoatmospheric Kill Vehicle (EKV), the Lightweight Exoatmospheric Projectile (LEAP), and the Multiple Kill Vehicle (MKV).

KKVs are designed to intercept and destroy the target re-entry vehicle during the mid-course phase of the re-entry vehicle flight. The interception may occur above the earth's atmosphere at altitudes in excess of 100 miles. The combined speed of the KKV and the target re-entry vehicle may approach 15,000 miles per hour, or over 20,000 feet per second, such that a collision between the KKV and the re-entry vehicle will severely damage or destroy the re-entry vehicle. Given the high speeds of both vehicles, the KKV typically attempts to maneuver to assume a trajectory that is a reciprocal of the trajectory of the target re-entry vehicle, which is to say that the kill vehicle and target re-entry vehicles are traveling on the same or nearly the same trajectory in opposing directions. In reality, the kill vehicle will deviate from the desired reciprocal trajectory by an error amount, commonly termed the CEP or circular error probable. The CEP is defined as the radius of a circle about the desired trajectory that would contain the kill vehicle 50% of the time. A normal distribution of the vehicle navigation errors is commonly assumed, such that the kill vehicle will be within a circle having a radius of twice the CEP 93% of the time and within a circle having a radius of three times the CEP more than 99% of the time. Given the relatively small sizes of the hit-to-kill vehicle and the target re-entry vehicle and the extreme closing speed, the CEP of the KKV may need to be less than a fraction of a meter to provide a high probability of colliding with the target re-entry vehicle. These extremely precise navigational requirements complicate the design and raise the cost of the ballistic missile defense systems presently in development.

Throughout this description, elements appearing in figures are assigned three-digit reference designators, where the most significant digit is the figure number and the two least significant digits are specific to the element. An element that is not described in conjunction with a figure may be presumed to have the same characteristics and function as a previously-described element having a reference designator with the same least significant digits.

DETAILED DESCRIPTION

Description of Apparatus

Figure 1:
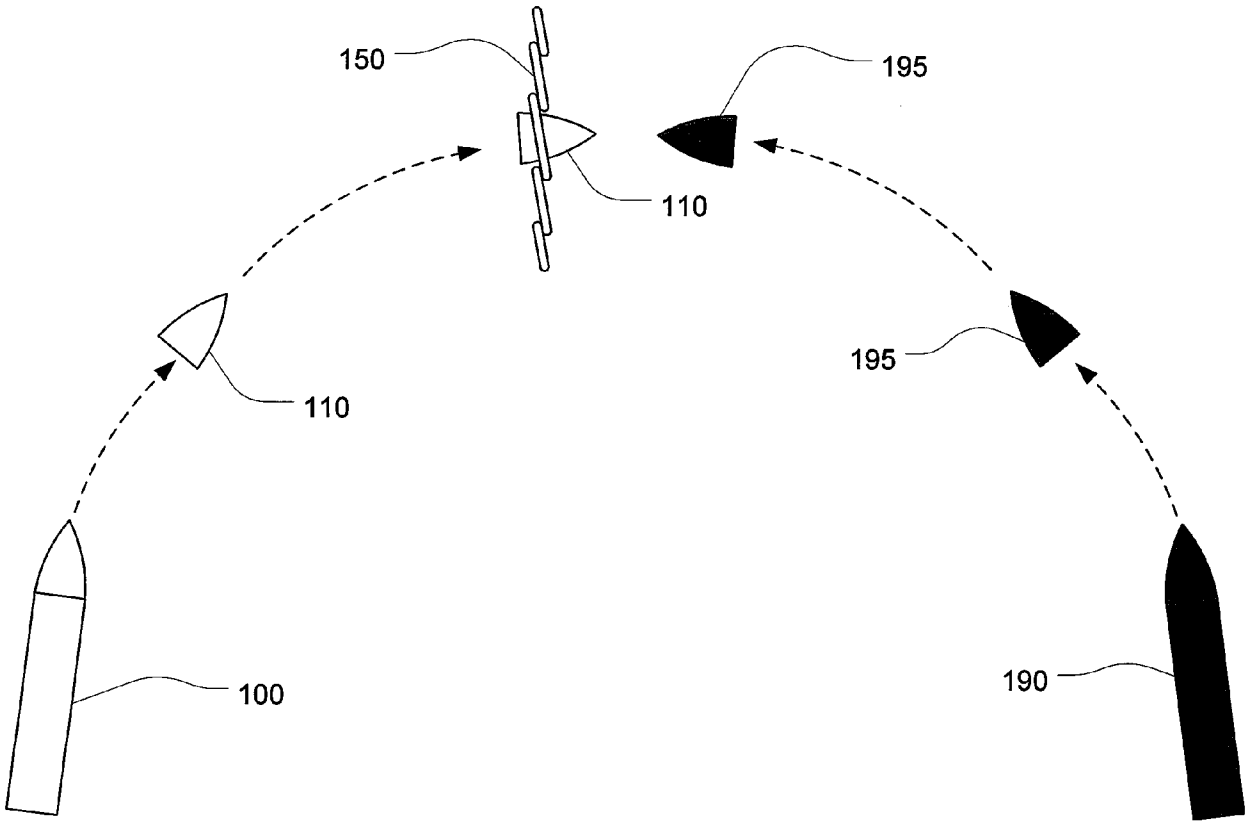
FIG. 1 is a schematic representation of an engagement between a large cross-section kill vehicle and a target re-entry vehicle.

Referring now to FIG. 1, an engagement between a KKV and a re-entry vehicle may begin when the launch of a ballistic missile 190 is detected. The launch may be detected by a ground-based early warning radar, a satellite-based infrared sensor, or some other sensor system. The ballistic missile 190 may be tracked by one or more sensor systems and an intended destination may be estimated. The ballistic missile 190 may include one or more rocket stages, which are not shown individually in FIG. 1. Some time after launch, the ballistic missile 190 may release a re-entry vehicle 195 containing a warhead. The ballistic missile may release other re-entry vehicles (not shown in FIG. 1) in addition to the re-entry vehicle 195, or may release a plurality of re-entry vehicles and decoy vehicles (not shown in FIG. 1).

At some time after the detection of the ballistic missile launch, an interceptor missile 100 may be launched to intercept the re-entry vehicle 195. The interceptor missile 100 may include one or more rocket stages, which are not shown individually in FIG. 1. Some time after launch, the interceptor missile may release a kill vehicle 110. The interceptor missile 100 may release other kill vehicles (not shown in FIG. 1) in addition to the kill vehicle 110. The other kill vehicles may be assigned to intercept other re-entry vehicles released by the ballistic missile 190. In some engagements, more than one kill vehicle may be assigned to intercept the re-entry vehicle 195.

The kill vehicle 110 may navigate a collision course with the re-entry vehicle 195 in an attempt to destroy the re-entry vehicle 110 by physical collision. In this patent, the term "collision course" is intended to mean a course where the CEP of the kill vehicle is centered on a trajectory that is reciprocal to the trajectory of the re-entry vehicle. Note, however, that a collision between a kill vehicle traveling on a "collision course" and a target re-entry vehicle is not guaranteed. To maximize the probability of a collision between the kill vehicle 110 and the re-entry vehicle 195, the kill vehicle 110 may deploy an expandable collar 150 that greatly increases the cross-sectional area of the kill vehicle 110 shortly before the anticipated impact with the re-entry vehicle 195. The collar 150 may include a plurality of inflatable bags or "ballutes" that may be inflated to extend from the kill vehicle. Within this patent, the inflatable elements of the collar 150 will be referred to as "ballutes". The word "ballute" (a contraction or portmanteau of "balloon" and "parachute") was originally coined to describe inflatable parachutes, which are similar in appearance and structure to the inflatable elements of the collar 150. The material, construction, packaging, and inflation technology of the ballutes may be adapted from automotive airbag technology.

Figure 2:
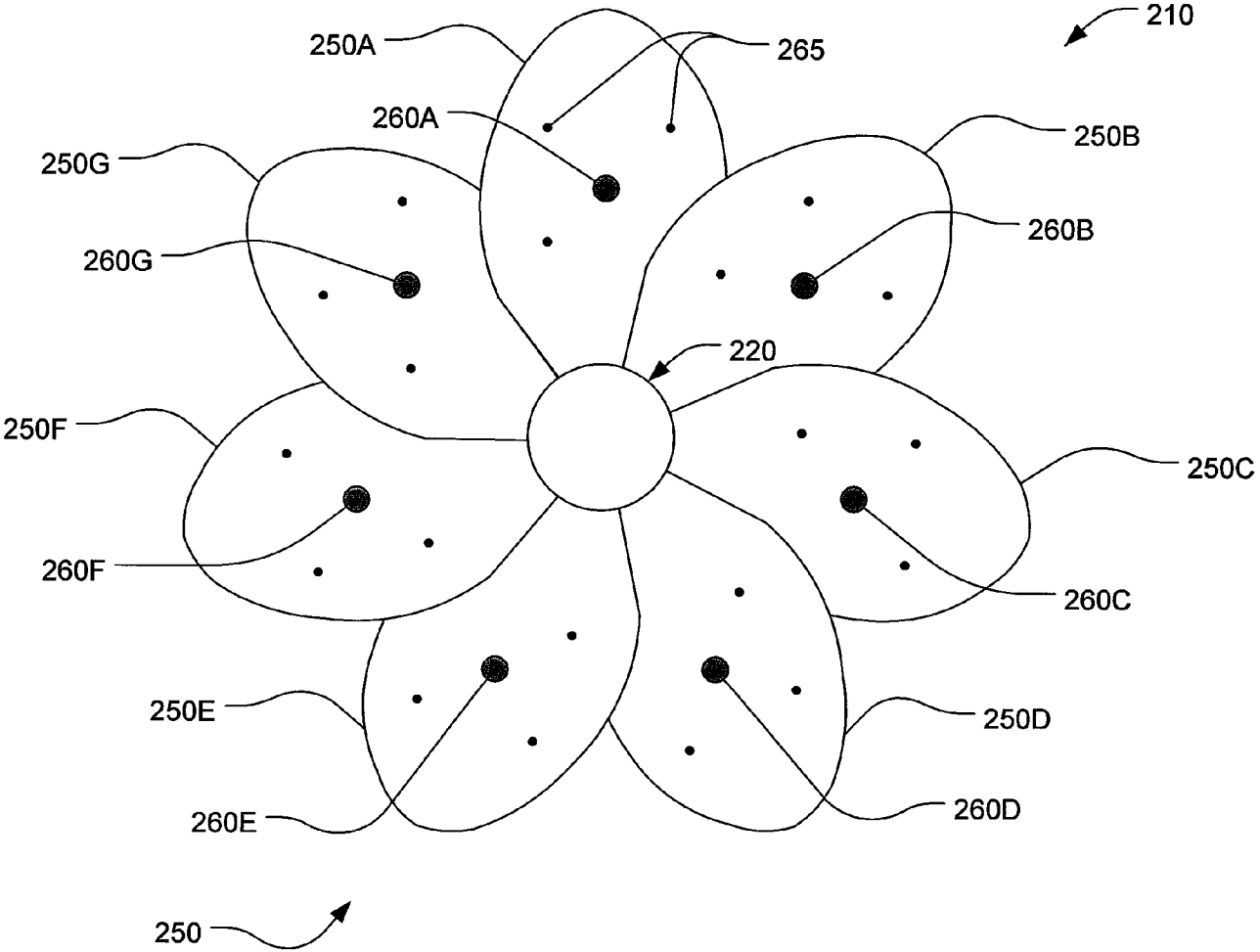
FIG. 2 is a frontal view of a large cross-section kill vehicle.

FIG. 2 shows a frontal view of an exemplary kill vehicle 210 with a collar 250 composed of a plurality of ballutes extending generally radially from a kill vehicle body 220. In this example, the collar 250 is composed of seven ballutes 250A, 250B, 250C, 250D, 250E, 250F, and 250G. The use of seven ballutes 250A-G is an example, and more or fewer ballutes may extend from the kill vehicle body 220. The ballutes 250A-G may be generally petal-shaped as shown in FIG. 2, triangular, or some other shape. The ballutes 250A-G may be partially overlapping as shown in FIG. 2, fully overlapping, or non-overlapping.

The number of ballutes and the size of each ballute may be a compromise between the desire to increase the cross-sectional area of the kill vehicle and the limited volume available for storing the ballutes within the kill vehicle. Thus the number and size of the ballutes may be different for kill vehicles of different sizes. The number of ballutes, the overlap of the adjacent ballutes, the thickness of each ballute, and other parameters may be determined, for example, by simulation of engagements with target re-entry vehicles.

Each of the ballutes 250A-G may be an inflatable bag made from a flexible fabric. Suitable fabrics may include continuous films, knit or woven materials, hybrid materials combining a continuous film with a reinforcing knit or woven material, and other materials.

Explosive charges may be disposed on at least some of the ballutes 250A-G. As shown in the example of FIG. 2, a single explosive charge 260A-G may be disposed on each ballute 250A-G, respectively. Plural explosive charges may be distributed on each ballute to obtain a desired distribution of the weight and/or explosive force. The explosive charges may be affixed to an exterior or interior surface of the ballute fabric, or may be otherwise disposed on or within the ballutes. One or more of the explosive charges 260A-G may be detonated when a target re-entry vehicle impacts one of the ballutes 250A-G.

Hard masses or particles 265, intended to damage a target re-entry vehicle through impact, may be disposed on at least some of the ballutes 250A-G. The masses may be affixed to an exterior or interior surface of the ballute fabric, or may be otherwise disposed on or within the ballutes. The number of position of the masses disposed on each ballute may be selected to ensure impact between at least one mass and a target re-entry vehicle.

Prior to deployment, the plurality of ballutes 250A-G may be folded or rolled and stored within the kill vehicle body 220. The ballutes 250A-G may then be deployed using a combustible gas generator to inflate each ballute in a manner similar to the inflation of an automotive airbag.

The need for airbags to protect automobile occupants during front-impact and side-impact collisions has led to extensive development of airbag fabrics and materials, airbag folding methods and equipment, and airbag gas generators and inflation technology which may be adapted for use in the kill vehicle 210. Extensive airbag simulation techniques and software tools have also been developed which may be applied in the design of the kill vehicle 210. Exemplary software tools which have been used for airbag simulation include PAM-SAFE available from ESI Group, LS-DYNA available from Dynamore GmbH, and MADYMO available from TNO Automotive Safety Systems.

The plurality of ballutes 250A-G may differ from typical automotive airbags in several features. Each ballute 250A-G may have a radial length of more than 1 meter and may have a substantially larger volume than a typical automotive airbag. In compensation, the ballutes 250A-G may be deployed in advance of an anticipated collision with a target re-entry vehicle, as opposed to an automotive airbag which is inflated during the collision. Thus the ballutes 250A-G may be deployed an adequate time in advance of intercepting the target re-entry vehicle to allow full inflation of the larger volume. Further, automotive airbags are typically designed with vents such that the bag deflates gradually and automatically after inflation. The ballutes 250A-G may be constructed without vents such that the ballute 350A remains fully inflated until impact. In addition, the ballutes 250A-G may contain or support objects, such as the explosive charges 260A-G and/or masses 265, having a high mass density compared to the airbag fabric. Since available airbag simulation software tools are based on finite element models, these tools may directly support simulation and design of ballutes including dense objects.

Figure 3:
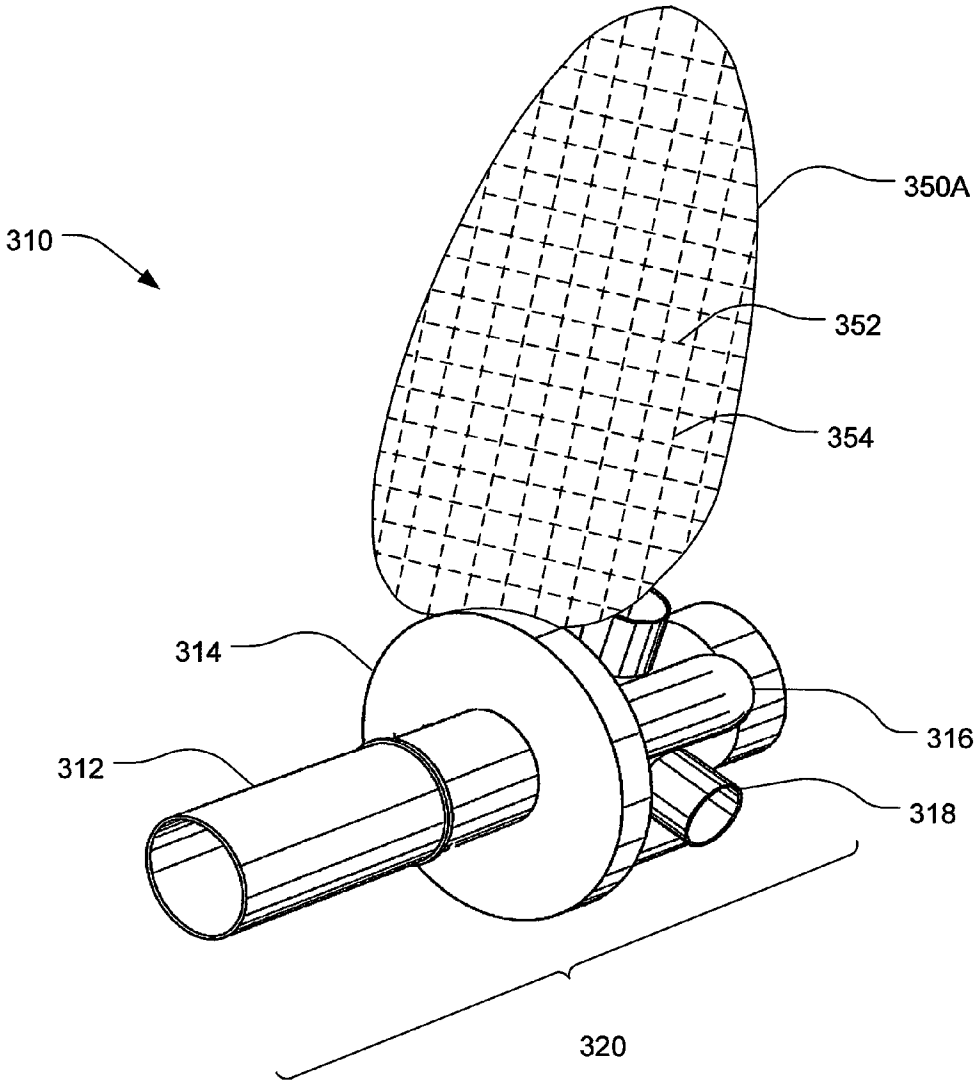
FIG. 3 is a partial perspective view of a large cross-section kill vehicle.

FIG. 3 is a partial perspective view of an exemplary kill vehicle 310 which may be the kill vehicle 210. In FIG. 3, only a single ballute 350A, which is representative of a plurality of ballutes, is shown. The kill vehicle 310 may have a body 320. A telescope 312 for an infrared seeker or some other seeker system may be mounted or supported at the front of the body. The kill vehicle body 320 may enclose or support various electronic subsystems and may include one or more fuel tanks 316 and navigation thrusters 318. The kill vehicle body 320 may include a housing 314 from which the plurality of ballutes may be deployed.

Prior to deployment, the plurality of ballutes may be folded or rolled and stored within the housing 314. The ballutes may then be deployed using one or more combustible gas generators to inflate each ballute.

Each ballute 350A may be constructed of a fabric which may include reinforcing elements such as fine threads, fibers, or wires. For example, each ballute 350A may include reinforcing elements in a mesh pattern as indicated by the dashed lines 352 and 354. The ballute material including the reinforcing elements may be adapted to cause the ballute to wrap around, at least in part, the target re-entry vehicle upon impact.

Figure 4:
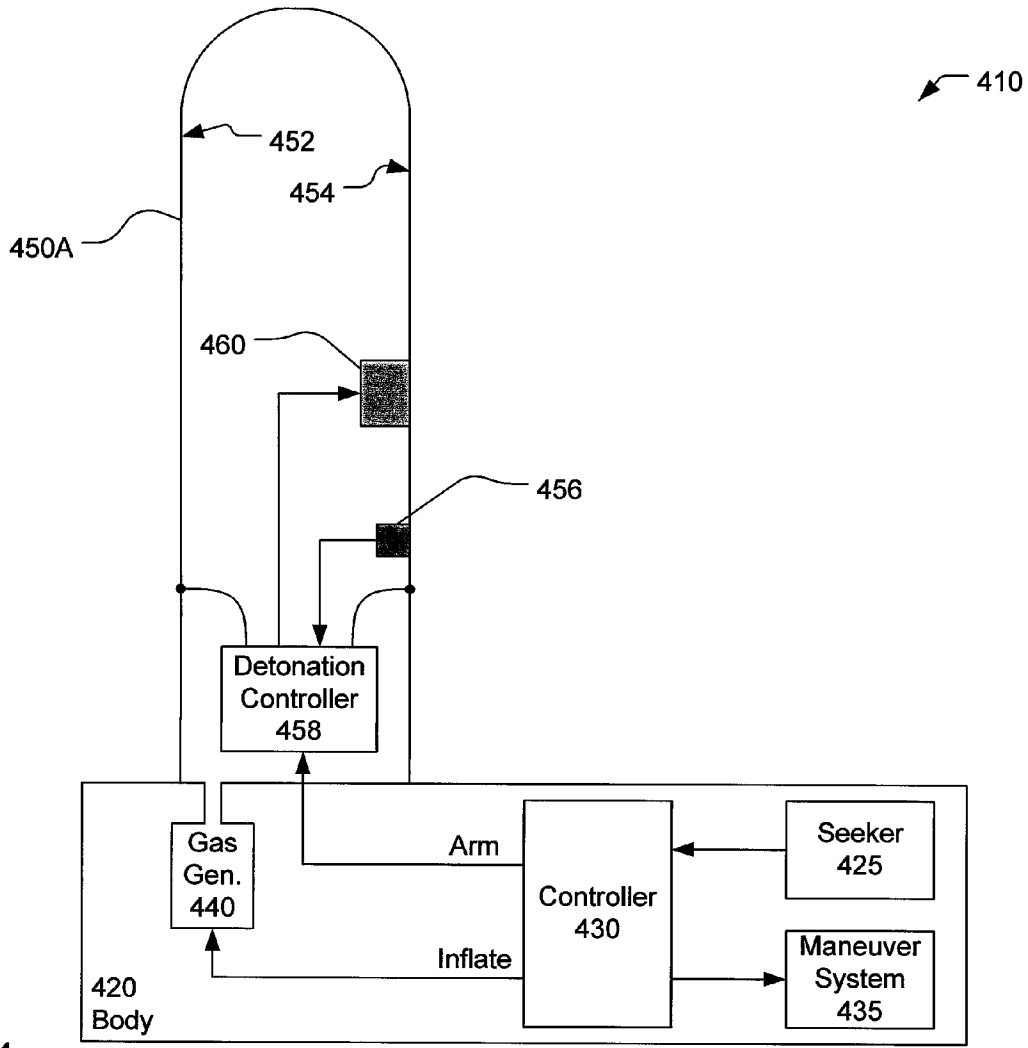
FIG. 4 is a block diagram of a large cross-section kill vehicle.

FIG. 4 shows a block diagram of a kill vehicle 410 including a body 420 and a single ballute 450A which is representative of a plurality of ballutes extended from the body 420. The body 420 may enclose or support a seeker 425, such as an imaging infrared seeker or other seeker, to detect and track a target re-entry vehicle (not shown), a controller 430, and a maneuver system 435 which may include maneuvering thrusters. The controller 430 may track the target re-entry vehicle using the seeker 425 and may control the maneuvering system 435 to place the kill vehicle 410 onto a collision course with the target re-entry vehicle. The controller 430 may, at an appropriate time prior to the anticipated collision with the target re-entry vehicle, control one or more gas generators 440 to inflate the plurality of ballutes such as ballutes 450A. The controller 430 may, after the ballutes have been inflated, arm a detonation controller 458 coupled to explosive charges 460 within at least some of the ballutes.

The controller 430 may include software and/or hardware for providing functionality and features described herein. The controller 430 may therefore include one or more of: logic arrays, memories, analog circuits, digital circuits, software, firmware, and processors such as microprocessors, field programmable gate arrays (FPGAs), application specific integrated circuits (ASICs), programmable logic devices (PLDs) and programmable logic arrays (PLAs). The processes, functionality and features may be embodied in whole or in part in software which operates on the controller and may be in the form of firmware, an application program, or an operating system component or service. The hardware and software and their functions may be distributed such that some components are performed by the controller 430 and others by other devices.

The detonation controller 458 may be disposed, as shown in FIG. 4, within the ballute 450A to allow the explosive charge 460 to detonate if the ballute 450A detaches from the kill vehicle 410 during the collision with the target re-entry vehicle. A plurality of detonation controllers, such as the detonation controller 458, may be disposed respectively within the plurality of ballutes. If the ballutes, such as ballute 450A, are designed to not detach from the kill vehicle 410 during the collision with the target re-entry vehicle, a single detonation controller 458 may be disposed within or on the body 420 to control the detonation of explosive charges within the plurality of ballutes.

The detonation controller 458 may cause the explosive charge 460 to detonate at a specific time, as instructed by the controller 430. The specific time may be an anticipated time of collision with the target re-entry vehicle. One or more impact sensors 456 may be attached to the ballute 450A and the detonation controller 458 may cause the explosive charge 460 to detonate upon impact with the target re-entry vehicle based on signals from the impact sensors 456. The impact sensors 456 may be, for example, accelerometers or other sensors. The impact sensors 456 may be, for example, affixed to an exterior or interior surface of the ballute or otherwise disposed within the ballute.

The detonation controller 458 may cause the explosive charge 460 to detonate based upon an electrical trigger switch incorporated into the structure of the ballute 450A. Electrical conductors may be disposed on the opposing inner surfaces 452, 454 of the ballute 450A. These conductors may be an array of wires incorporated into or attached to the surfaces 452, 454 or conductive films deposited on or laminated to the surfaces 452, 454. Prior to collision with the target re-entry vehicle, the electrical conductors on the surface 452 may be electrically isolated from the electrical conductors on the surface 454. During collision with the target re-entry vehicle, the electrical conductors on surface 452 may be forced into contact with the electrical conductor on the surface 454, completing an electric circuit that initiates the detonation of the explosive charge 456. The detonation controller 458 may cause the explosive charge to detonate immediately or after a short delay that may allow the ballute 450A to wrap around, at least partially, the target re-entry vehicle.

Description of Processes

Figure 5:
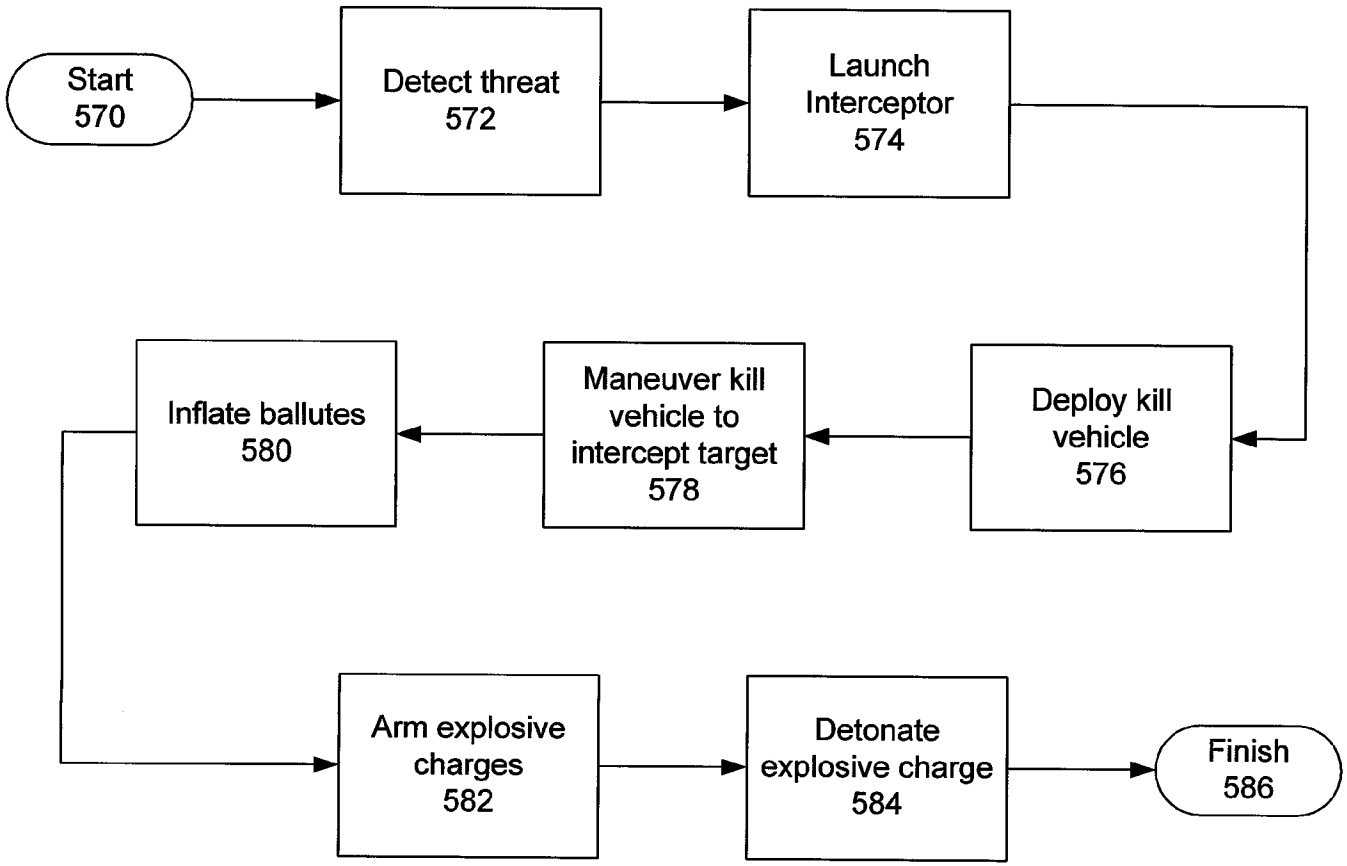
FIG. 5 is a flow chart of a process for engaging a threat.

Referring now to FIG. 5, a flow chart of a process for engaging a ballistic missile target has a start at 570, and a finish at 586. At the start of the process at 570, systems for detecting threats and for launching interceptors are deployed. At the conclusion of the process at 586, a threat has been intercepted and, if the engagement is successful, destroyed.

At 572, the launch of a ballistic missile threat may be detected. The launch may be detected by a ground-based early warning radar, a satellite-based infrared sensor, or some other sensor system. The threat may be tracked by one or more sensor systems and an intended destination may be estimated. Some time after launch, the threat may release a target re-entry vehicle which may contain a nuclear, biological, chemical, or conventional warhead. The threat may release a plurality re-entry vehicles or a plurality of re-entry vehicles and decoy vehicles. The process of FIG. 5 is directed to intercepting and destroying a specific target re-entry vehicle.

At some time after the detection of the threat launch at 572, an interceptor missile may be launched at 574 to intercept the target re-entry vehicle. At 576, at a predetermined time after launch, the interceptor missile may deploy at least one kill vehicle assigned to intercept the target re-entry vehicle.

At 578, the kill vehicle 110 may navigate to a reciprocal of the trajectory of the target re-entry vehicle such that a collision will occur between the kill vehicle and the target re-entry vehicle. To ensure a collision between the kill vehicle and the re-entry vehicle, at 580, the kill vehicle may deploy an expandable collar composed of a plurality of inflatable ballutes that greatly increases the cross-sectional area of the kill vehicle. The ballutes may be inflated at 580 shortly before the anticipated collision with the target re-entry vehicle.

At 582, prior to the anticipated collision with the target re-entry vehicle, explosive charges within at least some of the ballutes may be armed. At 584, one or more of the explosive charges may be detonated. The explosive charges may be detonated at 584 at anticipated time of collision, or when the collision is sensed by a sensor and/or an electrical trigger circuit incorporated within the ballutes.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

For means-plus-function limitations recited in the claims, the means are not intended to be limited to the means disclosed herein for performing the recited function, but are intended to cover in scope any means, known now or later developed, for performing the recited function.

As used herein, "plurality" means two or more.

As used herein, a "set" of items may include one or more of such items.

As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

It is claimed:

1. A vehicle, comprising:

a vehicle body;

a maneuvering system coupled to the vehicle body, the maneuvering system operable to maneuver the vehicle onto a collision course with a target a plurality of inflatable ballutes which, when inflated, extend generally radially from the vehicle body;

a plurality of explosive charges disposed on at least some of the ballutes;

a controller adapted to cause the ballutes to be inflated prior to an anticipated time of collision with the target; and a detonation controller coupled to the controller and to the plurality of explosive charges.

2. The vehicle of claim 1, further comprising:

a seeker coupled to provide target position data to the controller; and a maneuvering system coupled to the controller, wherein the controller controls the maneuvering system to maneuver the vehicle body onto a collision course with the target based on, at least in part, the target position data.

3. The vehicle of claim 1, wherein the controller arms the detonation controller after the ballutes are inflated.

4. The vehicle of claim 3, wherein the controller provides an anticipated time of collision to the detonation controller, and the detonation controller causes one or more of the plurality of explosive charges to detonate at an anticipated time of collision with the target.

5. The vehicle of claim 3, wherein the detonation controller causes one or more of the plurality of explosive charges to detonate in response to an impact sensor attached to one of the ballutes.

6. The vehicle of claim 3, wherein the detonation controller causes one or more of the plurality of explosive charges to detonate in response to a trigger switch incorporated in one of the ballutes.

7. The vehicle of claim 6, wherein the electrical trigger switch comprises first and second electrical conductors disposed on opposing inner surfaces of the ballute, the first and second electrical conductors forced into contact during the collision with the target.

8. The vehicle of claim 6, wherein the trigger switch is a corresponding plurality of electrical trigger switches incorporated into the plurality of ballutes.

9. The vehicle of claim 1, wherein the detonation controller comprises a plurality of detonation controllers attached to respective ballutes, each of the plurality of detonation controllers coupled to one or more explosive charges attached to the respective ballute.

10. The vehicle of claim 1, the vehicle body further comprising a housing, wherein the ballutes are held folded within the housing prior to inflation.

11. A method of engaging a target re-entry vehicle, comprising:

maneuvering a kill vehicle onto a collision course with the target;

prior to an anticipated time of collision with the target, inflating a plurality of ballutes to increase a cross-sectional area of the kill vehicle;

after inflating the ballutes, arming one or more explosive charges disposed on at least some of the ballutes; and detonating one or more of the explosive charges.

12. The method of claim 11, wherein the one or more explosive charges are detonated at the anticipated time of collision.

13. The method of claim 11, wherein the one or more explosive charges are detonated in response to impact sensors attached to at least some of the ballutes.

14. The method of claim 11, wherein the one or more explosive charges are detonated in response to an electrical trigger switch incorporated into one of the ballutes.

15. The method of claim 14, wherein the electrical trigger switch comprises first and second electrical conductors on opposing inner surfaces of the ballutes, the first and second electrical conductors forced into contact during the collision with the target.

16. The method of claim 14, wherein a corresponding plurality of electrical trigger switches are incorporated into the plurality of ballutes.

17. A vehicle, comprising:

a vehicle body;

means for maneuvering the vehicle body onto a near collision course with a target;

means for inflating a plurality ballutes which, when inflated, extend generally radially from the vehicle body; and means for detonating one or more explosive charges attached to at least some of the ballutes.

* * * * *